US006799977B2

(12) United States Patent
Liu

(10) Patent No.: US 6,799,977 B2
(45) Date of Patent: Oct. 5, 2004

(54) SOCKET HAVING FOAM METAL CONTACTS

(75) Inventor: Weifeng Liu, Roseville, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/194,109

(22) Filed: Jul. 11, 2002

(65) Prior Publication Data

US 2004/0009686 A1 Jan. 15, 2004

(51) Int. Cl.[7] ..... H01R 39/00
(52) U.S. Cl. ..... 439/66; 439/91
(58) Field of Search ..... 439/66, 91, 70

(56) References Cited

U.S. PATENT DOCUMENTS 4,064,623 A * 12/1977 Moore ..... 29/876
5,039,628 A 8/1991 Carey ..... 228/181.21
5,074,799 A * 12/1991 Rowlette, Sr. ..... 439/91
5,174,766 A * 12/1992 Yoshizawa et al. ..... 439/91
5,599,193 A * 2/1997 Crotzer ..... 439/66
5,624,268 A * 4/1997 Maeda et al. ..... 439/66
5,701,233 A * 12/1997 Carson et al. ..... 361/735
5,860,818 A * 1/1999 Sakaki et al. ..... 439/91
6,059,579 A * 5/2000 Kresge et al. ..... 439/66
6,280,207 B1 * 8/2001 Sakata et al. ..... 439/91

FOREIGN PATENT DOCUMENTS

EP 1104050 A 5/2001
JP 5226054 A 9/1993

* cited by examiner

*Primary Examiner*—Tulsidas C. Patel

(57) ABSTRACT

A socket and methods of manufacturing the socket are disclosed. The socket facilitates electrical interconnection. In an embodiment, the socket includes an insulating substrate having a first surface and a second surface that is on an opposite side relative to the first surface. The insulating substrate includes a plurality of apertures each aperture providing a passage between the first and second surfaces. Moreover, the socket includes a plurality of conductive contacts. Each conductive contact is positioned in a respective one of the apertures such that a first end of the conductive contact extends from the first surface and a second end of the conductive contact extends from the second surface. Additionally, each conductive contact is comprised of a foam metal. Alternatively, each conductive contact is comprised of a foam metal and an elastomer.

21 Claims, 6 Drawing Sheets

SOCKET HAVING FOAM METAL CONTACTS

BACKGROUND OF THE INVENTION

1. Field of the Invention

The present invention generally relates to electrical interconnections. More particularly, the present invention relates to sockets.

2. Related Art

While solder is used to form a permanent direct electrical interconnection between components, a socket (also called an interposer in certain applications) is used to form a detachable electrical connection between components (e.g., for processor chip upgrades in computers). Typically, the socket is designed to support a second level electrical interconnection, whereas a first component is electrically coupled to the socket and the socket is electrically coupled to a second component such as a circuit board. Generally, the I/O contact surface of the first component (e.g., a chip package or circuit board) and the I/O contact surface of the second component (e.g., a circuit board, a mother circuit board, etc.) are not planar. Hence, the socket is used to compensate for the non-planarity of these I/O contact surfaces. In particular, the socket has contacts for providing mechanical compliance (i.e., compressibility) and electrical conduction between the first component and the second component. Typically, a compression mechanism provides a compression force for securely maintaining the socket between the first component and the second component.

Although a solid metal is able to transfer electrical signals, its high rigidity prevents its usage in sockets. Thus, different designs for the contacts of the socket have been developed to increase the compliance (i.e., compressibility) of the contacts. These contact designs include a wire button, cantilever springs, pogo pin springs, and an elastomer having metal particles or metal wires embedded inside.

Each of these conventional contact designs is deficient in some manner. For example, some of these conventional contacts are costly to manufacture and are difficult to manufacture. Moreover, other conventional contacts require a large compression force to maintain an electrical connection with the first and second components. Yet still, some conventional contacts wipe or slide on the I/O pads of the first and second components to such a degree to cause extensive wear to the gold plating of the I/O pads. In other cases, the failure mechanism of these conventional contact designs is not well known.

SUMMARY OF THE INVENTION

A socket and methods of manufacturing the socket are disclosed. The socket facilitates electrical interconnection. In an embodiment, the socket includes an insulating substrate having a first surface and a second surface that is on an opposite side relative to the first surface. The insulating substrate includes a plurality of apertures each aperture providing a passage between the first and second surfaces. Moreover, the socket includes a plurality of conductive contacts. Each conductive contact is positioned in a respective one of the apertures such that a first end of the conductive contact extends from the first surface and a second end of the conductive contact extends from the second surface. Additionally, each conductive contact is comprised of a foam metal. Alternatively, each conductive contact is comprised of a foam metal and an elastomer.

BRIEF DESCRIPTION OF THE DRAWINGS

The accompanying drawings, which are incorporated in and form a part of this specification, illustrate embodiments of the invention and, together with the description, serve to explain the principles of the present invention.

The drawings referred to in this description should not be understood as being drawn to scale except if specifically noted.

DETAILED DESCRIPTION OF THE INVENTION

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention.

A socket and methods of manufacturing the socket are disclosed. The socket facilitates electrical interconnection between a first component and a second component. The socket includes an insulating substrate and a plurality of conductive contacts. Each conductive contact is comprised of a foam metal. Alternatively, each conductive contact is comprised of a foam metal and an elastomer. The foam metal eliminates or reduces the problems associated with conventional contact designs. Moreover, the foam metal ensures a redundant contact interface or multi-point contact between the I/O contact pads of the first and second components and the conductive contacts of the socket to provide improved reliability and improved conduction characteristics.

Figure 2:
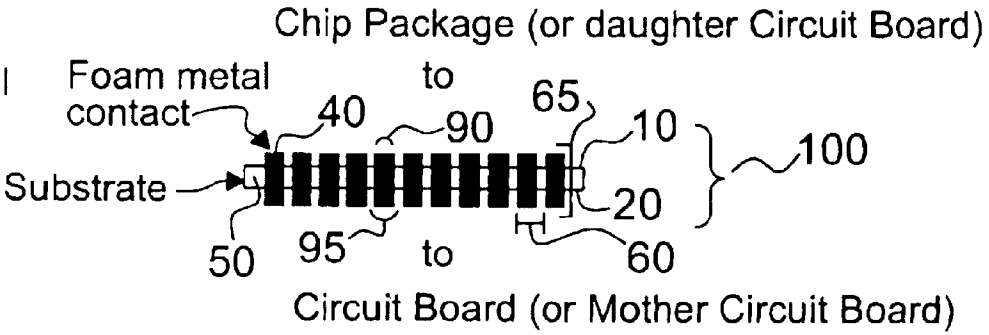
FIG. 2 illustrates a cross-sectional view of a socket in accordance with an embodiment of the present invention.
Figure 1:
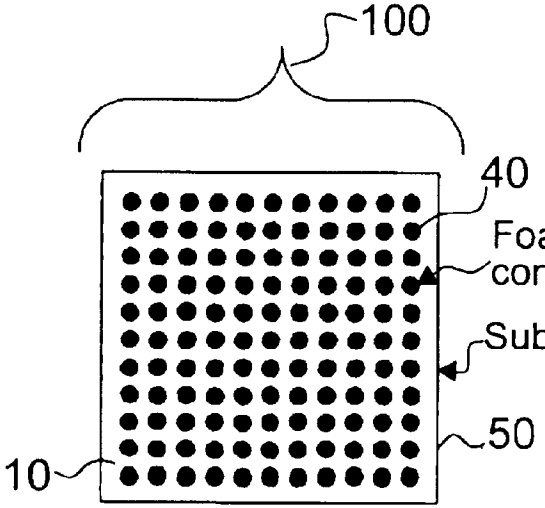
FIG. 1 illustrates a top plan view of a socket in accordance with an embodiment of the present invention.
Figure 3A:
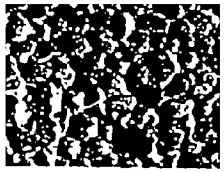
FIGS. 3A–3G illustrate exemplary foam metals in accordance with an embodiment of the present invention.
Figure 3B:
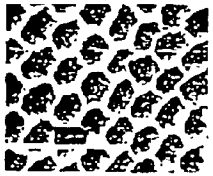
Figure 3C:
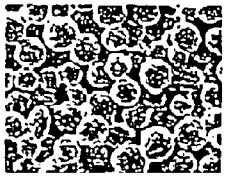
Figure 3D:
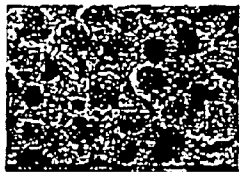
Figure 3E:
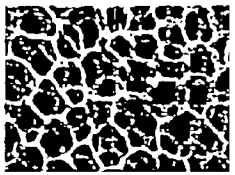
Figure 3F:
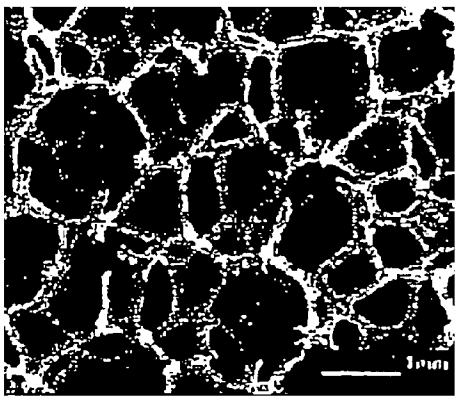
Figure 3G:
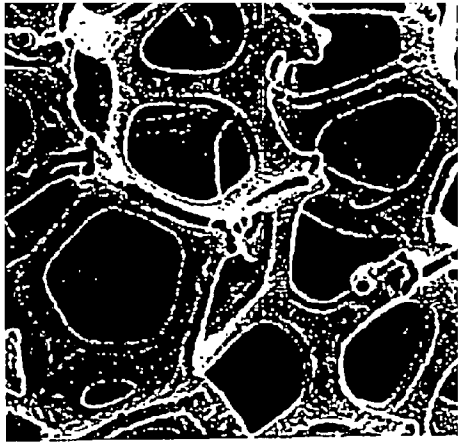

FIG. 1 illustrates a top plan view of a socket 100 in accordance with an embodiment of the present invention. It should be understood that a bottom plan view of the socket 100 is symmetrical to the top plan view. FIG. 2 illustrates a cross-sectional view of a socket 100 in accordance with an embodiment of the present invention. It should be understood that the socket is also known as an interposer in certain applications.

As depicted in FIGS. 1 and 2, the socket 100 includes an insulating substrate 50 having a first surface 10 and a second surface 20 that is on an opposite side relative to the first surface 10. The insulating substrate 50 includes a plurality of apertures each aperture providing a passage between the first 10 and second surfaces 20. The insulating substrate 50 can be flexible or rigid. Moreover, the insulating substrate 50 is comprised of a nonconductive material. For example, the nonconductive material can be a polymer such as a liquid crystal polymer. Alternatively, the nonconductive material can be a polyester or other type of nonconductive material. The insulating substrate 50 is also known as a housing, a carrier, or an insulator. It should be understood that the shape of the insulating substrate 50 can be configured into shapes other than that shown in FIGS. 1 and 2, such as rectangular rather than square.

Moreover, the socket 100 includes a plurality of conductive contacts 40. Each conductive contact 40 is positioned in a respective one of the apertures of the insulating substrate 40 such that a first end 90 of the conductive contact 40 extends from the first surface 10 and a second end 95 of the conductive contact 40 extends from the second surface 20. Each conductive contact 40 is comprised of a foam metal. Alternatively, each conductive contact 40 is comprised of a foam metal and an elastomer. The conductive contacts 40 are compliant (or compressible) and conductive.

In an embodiment, the apertures (and conductive contacts 40) are arranged on the insulating substrate 50 in a land grid array (LGA) format (which is an I/O configuration for interconnection). Hence, the socket 100 is a LGA socket 100. It should be understood that the present invention is applicable to sockets having apertures (and conductive contacts 40) arranged on the insulating substrate 50 in other types of formats. Moreover, the socket 100 can interconnect a chip package and a circuit board, a mother circuit board and a daughter circuit board, or any other components. It should be understood that the term "socket" encompasses board-to-board connectors as well as component-to-board interconnections. The term "component" includes components which are capable of being interconnected to circuit boards as well as circuit boards which are capable of being interconnected to circuit boards.

The spacing (or pitch) between the conductive contacts 40 is a design choice. Exemplary values for the pitch include 1.5 mm, 1.27 mm, 1.0 mm, and 0.8 mm. The pitch can be larger than 1.5 mm and lower than 0.8 mm. As depicted in FIGS. 1 and 2, the conductive contacts 40 are generally cylindrical in shape. However, the conductive contacts 40 can have other shapes. An exemplary value for the diameter 60 of the conductive contact 40 is 0.5 mm. Moreover, an exemplary value for the length 65 of the conductive contact 40 is less than 2 mm. It should be understood that the diameter 60 and the length 65 can have other values.

As illustrated in FIG. 2, the first end 90 of the conductive contacts 40 are utilized to electrically couple to a first component such as a chip package or a daughter circuit board. Moreover, the second end 95 of the conductive contacts 40 are utilized to electrically couple to a second component, such as a circuit board or a mother circuit board. Therefore, the socket 100 electrically couples the first component (e.g., chip package or a daughter circuit board) to the second component (e.g., a circuit board or a mother circuit board). Since the conductive contacts 40 are compliant (or compressible) and conductive, a compression mechanism (not shown) provides a compression force for securely maintaining the socket 100 between the first component (e.g., chip package or a daughter circuit board) and the second component (e.g., a circuit board or a mother circuit board) such that the conductive contacts 40 provide electrical conduction between the first component and the second component.

Figure 4A:
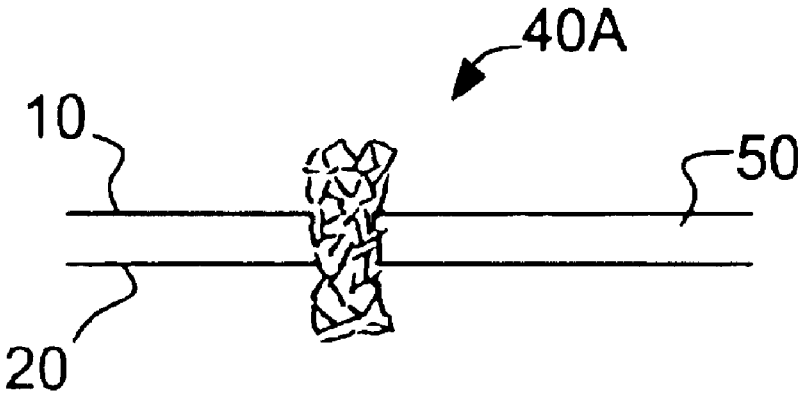
FIG. 4A illustrates a conductive contact comprised of a foam metal in accordance with an embodiment of the present invention.
Figure 4B:
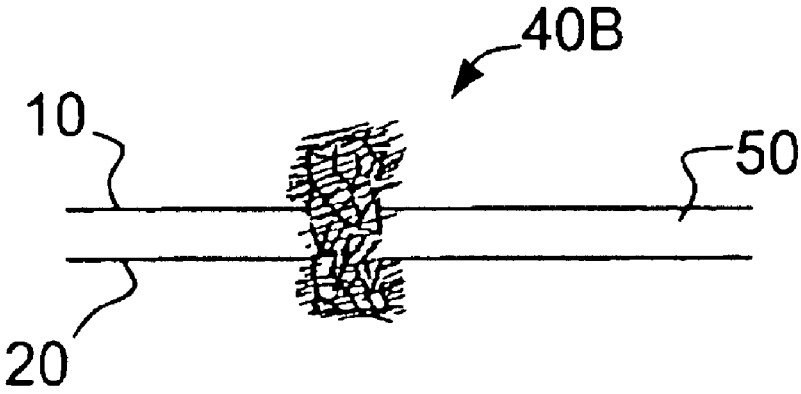
FIG. 4B illustrates a conductive contact comprised of a foam metal and an elastomer in accordance with an embodiment of the present invention.

As described above, each conductive contact 40 is comprised of a foam metal. Alternatively, each conductive contact 40 is comprised of a foam metal and an elastomer. FIGS. 3A–3G illustrate exemplary foam metals in accordance with an embodiment of the present invention. FIG. 4A illustrates a conductive contact 40A comprised of a foam metal in accordance with an embodiment of the present invention. FIG. 4B illustrates a conductive contact 40B comprised of a foam metal and an elastomer in accordance with an embodiment of the present invention. The foam metal eliminates or reduces the problems associated with conventional contact designs. Moreover, the foam metal ensures a redundant contact interface or multi-point contact between the I/O contact pads of the first and second components and the conductive contacts 40 of the socket 100 to provide improved reliability and improved conduction characteristics. Rather than utilizing the conventional contact designs, the conductive contacts 40 use the reduced density and porous characteristic of foam metal to provide compliance (or compressibility) to the conductive contacts 40. By controlling the porosity and density of the foam metal, a desired compliance characteristic can be obtained.

Several exemplary foam metals (also called metal foam or metallic foam) are depicted in FIGS. 3A–3G. In particular, a foam metal is a metallic material having voids and a continuous 3-D metal network. The foam metal can be manufactured by different processes. Moreover, the foam metal is compressible and can be machined, cut, rolled to form, drilled, brazed, and with care, welded. The term "foam metal" is intended to encompass the terms cellular metal, porous metal, metallic foam, and metal sponge. In a cellular metal, space is divided into distinct cells. The boundaries of these cells are made of solid metal, while the interiors are voids. In a porous metal, the metal has a multitude of pores, i.e., closed, curved gas voids with a smooth surface. In a metallic foam, a solid foam metal may originate from a liquid metal in which gas bubbles are finely dispersed in the liquid metal. The metallic foams are special cases of porous metals. In a metal sponge, space is filled by pieces of metal that form a continuous network and co-exist with a network of empty space which is also interconnected. These definitions are not intended to be mutually exclusive. Since real materials are imperfect, the distinctions described above are sometimes not easy to discern.

In an embodiment, the foam metal is comprised of a conductive metal which has desired conductive properties. For example, the foam metal can be copper, copper alloy, silver, silver alloy, gold, nickel, molybdenum, or another conductive metal. If a non-noble metal is selected for the foam metal, a plating layer may need to be applied to the foam metal. For example, the plating layer can be gold, gold over nickel, gold over palladium and nickel, or another type of plating layer.

Again referring to FIG. 4A, the conductive contact 40A is comprised of a foam metal. Moreover, the conductive contact 40A has a continuous 3-D metal network frame that co-exists with a network of empty space which is also interconnected. As depicted in FIG. 4A, the conductive contact 40A extends from the first surface 10 of the insulating substrate 50 and from the second surface 20 of the insulating substrate 50. The conductive contact 40A is less costly and less difficult to manufacture than conventional contact designs. Moreover, the foam metal ensures a redundant contact interface or multi-point contact between the I/O contact pads of the first and second components and the conductive contact 40A of the socket 100 to provide improved reliability and improved conduction characteristics. In addition, the foam metal provides a better compatibility with the gold plated I/O contact pads of the first and second components. The failure mechanism of the foam metal is understood unlike the failure mechanism of some conventional contact designs. Lastly, the conductive contact 40A minimizes any wiping or sliding motion on the I/O pads of the first and second components, reducing wear of the gold plating of the I/O pads.

Again referring to FIG. 4B, the conductive contact 40B is comprised of a foam metal and an elastomer. Moreover, the conductive contact 40B has a continuous 3-D metal network frame that co-exists with a network of empty space which is also interconnected. The elastomer is applied inside and outside the foam metal. Also, the elastomer can be a silicone elastomer or another type of elastomer. As depicted in FIG. 4B, the conductive contact 40B extends from the first surface 10 of the insulating substrate 50 and from the second surface 20 of the insulating substrate 50. Besides the benefits described above with respect to FIG. 4A, the elastomer provides additional benefits. In particular, the elastomer minimizes and prevents shorting multiple conductive contacts 40B. Moreover, the elastomer shields and protects the gold plated I/O contact pads of the first and second components from environmental gases (e.g., $SO_2$, $Cl_2$, etc.). Furthermore, the elastomer increases the friction between the conductive contact 40B and the wall of the insulating substrate 50, preventing the conductive contact 40B from detaching from the aperture of the insulating substrate 50.

Figure 5:
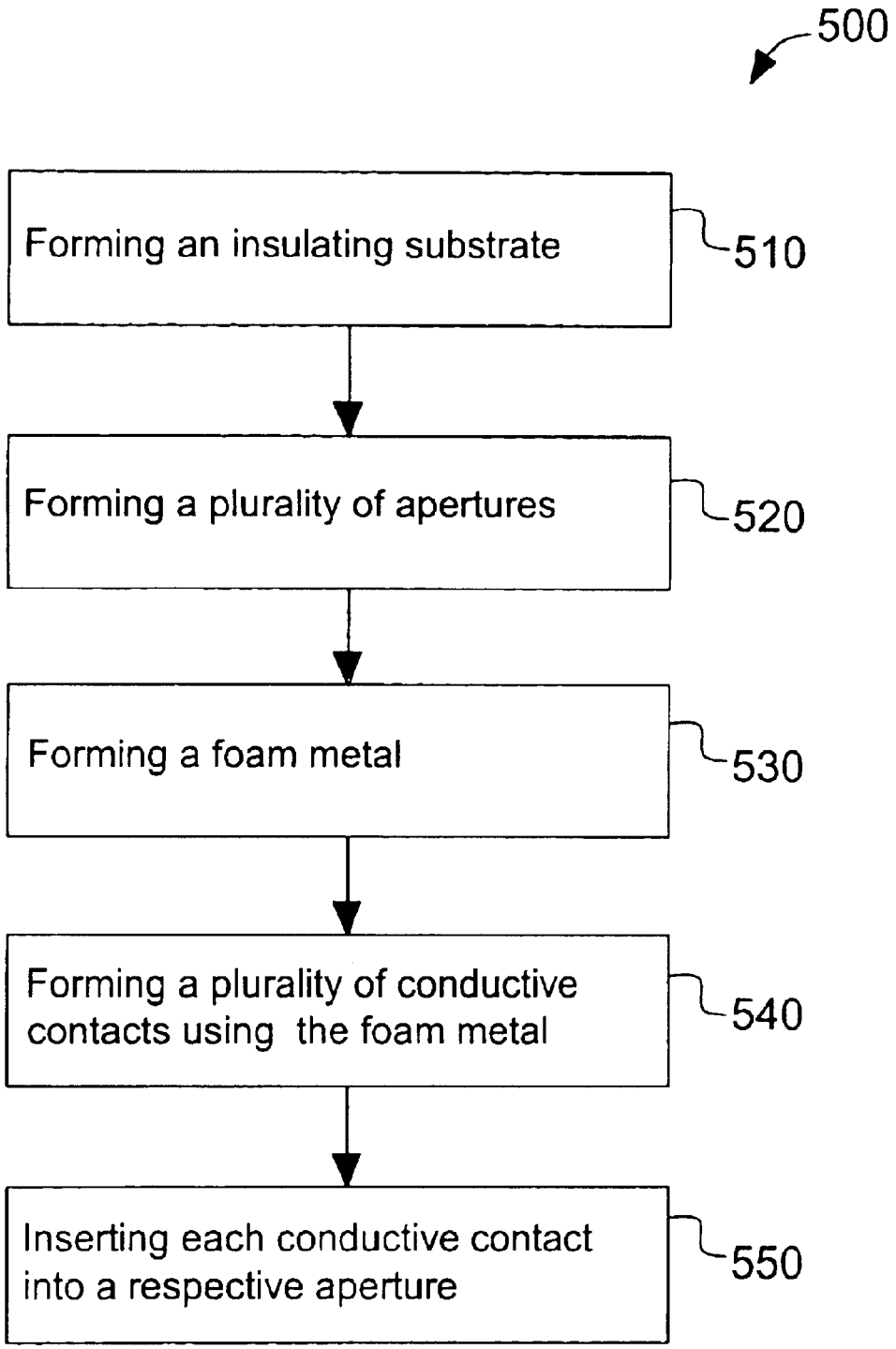
FIG. 5 illustrates a flow chart showing a first method of manufacturing a socket in accordance with an embodiment of the present invention.

FIG. 5 illustrates a flow chart showing a first method 500 of manufacturing a socket in accordance with an embodiment of the present invention. Reference is made to FIGS. 1–4B. At Block 510, an insulating substrate 50 is formed. The insulating substrate 50 can be flexible or rigid. Moreover, the insulating substrate 50 is comprised of a nonconductive material. For example, the nonconductive material can be a polymer such as a liquid crystal polymer. Alternatively, the nonconductive material can be a polyester or other type of nonconductive material. The insulating substrate 50 can be made through an injection molding process into the desired shape and dimensions. Alternatively, a sheet of nonconductive material (e.g., polymer sheet) can be made. The insulating substrate 50 can be cut from the sheet of nonconductive material (e.g., polymer sheet). At Block 520, a plurality of apertures are formed in the insulating substrate 50 for inserting therein the conductive contacts 40.

Continuing at Block 530, the foam metal is formed. The foam metal is comprised of a conductive metal which has desired conductive properties. For example, the foam metal can be copper, copper alloy, silver, silver alloy, gold, nickel, molybdenum, or another conductive metal. The foam metal can be produced through a variety of processes. For example, these processes include: bubbling gas through molten metal, stirring a foaming agent through a molten metal, consolidation of a metal powder with a particulate foaming agent, pressure infiltration of the molten metal into a wax or foam polymer precursor, and performing a vapor deposition process for the deposition of a metal onto the foam polymer precursor.

At Block 540, a plurality of conductive contacts 40 are formed using the foam metal. The foam metal can be cut and formed into the cylindrical shape and dimensions of the conductive contacts 40. Moreover, at Block 550, the plurality of conductive contacts 40 are inserted into the apertures of the insulating substrate 50.

As described above, if a non-noble metal is selected for the foam metal, a plating layer may need to be applied to the foam metal. For example, the plating layer can be gold, gold over nickel, gold over palladium and nickel, or another type of plating layer. Moreover, an elastomer can be applied inside and outside the foam metal of the conductive contact 40. The elastomer can be a silicone elastomer or another type of elastomer.

Figure 6:
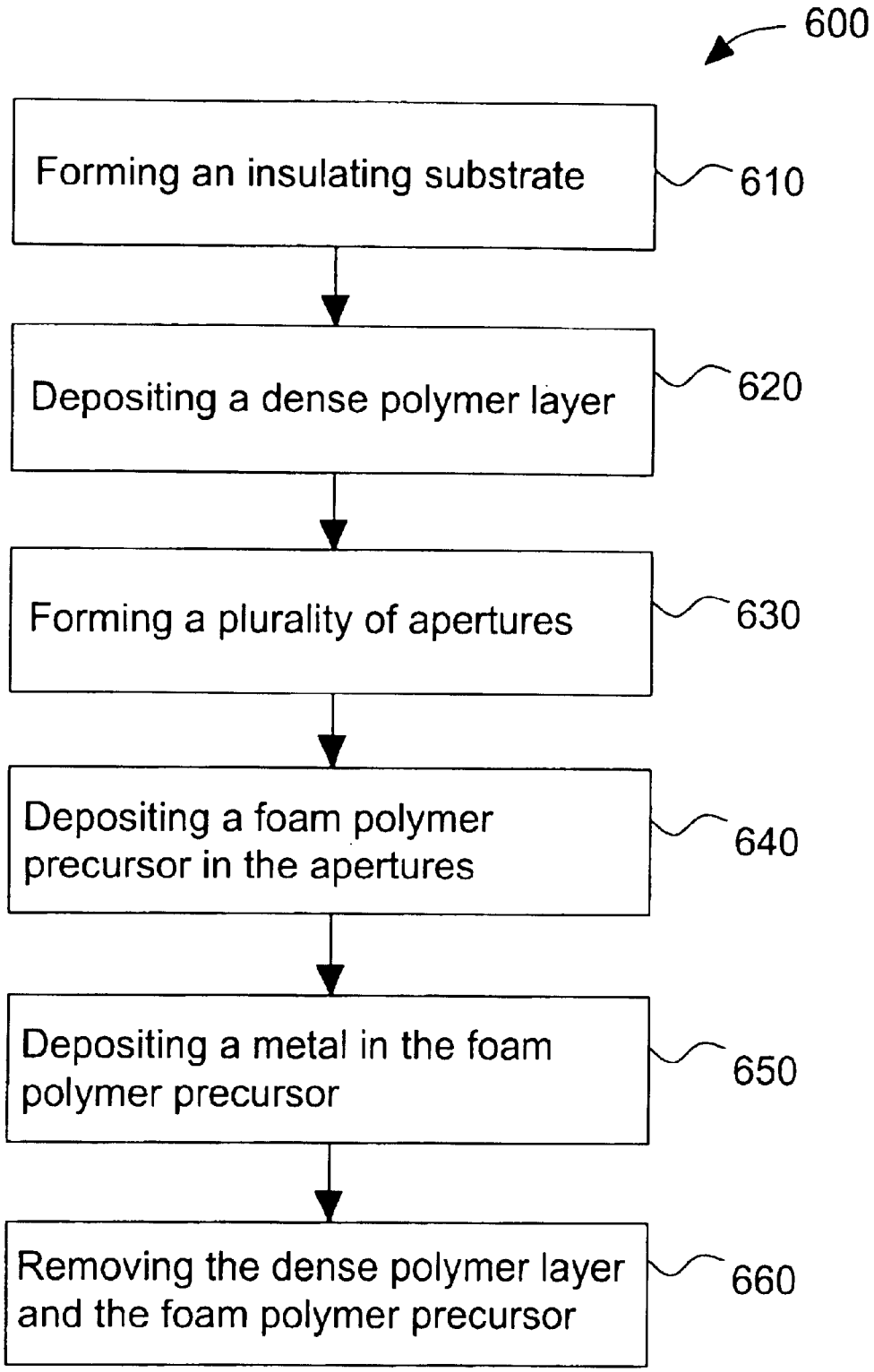
FIG. 6 illustrates a flow chart showing a second method of manufacturing a socket in accordance with an embodiment of the present invention.

FIG. 6 illustrates a flow chart showing a second method 600 of manufacturing a socket in accordance with an embodiment of the present invention. Reference is made to FIGS. 1–4B. At Block 610, an insulating substrate 50 is formed. The insulating substrate 50 can be flexible or rigid. Moreover, the insulating substrate 50 is comprised of a nonconductive material. For example, the nonconductive material can be a polymer such as a liquid crystal polymer. Alternatively, the nonconductive material can be a polyester or other type of nonconductive material. The insulating substrate 50 can be made through an injection molding process into the desired shape and dimensions. Alternatively, a sheet of nonconductive material (e.g., polymer sheet) can be made. The insulating substrate 50 can be cut from the sheet of nonconductive material (e.g., polymer sheet).

At Block 620, a dense polymer layer is deposited on the first side 10 and the second side 20 of the insulating substrate 50. At Block 630, a plurality of apertures are formed through the insulating substrate 50 and dense polymer layer for inserting therein the conductive contacts 40.

Continuing at Block 640, a foam polymer precursor is deposited in the apertures. The foam polymer precursor is porous. The foam polymer precursor acts like a deposition precursor for the metal forming the foam metal, thus, penetrating into the foam polymer precursor. However, the dense polymer layer does not allow the metal forming the foam metal to penetrate into it.

Furthermore at Block 650, the metal is deposited into the foam polymer precursor to form the foam metal. A variety of methods, such as physical vapor deposition, can be used. At Block 660, the dense polymer layer and the foam polymer precursor are removed by using an organic liquid or by evaporating them out, forming the conductive contacts 40. Each conductive contact 40 is located in an aperture of the insulating substrate 50.

As described above, if a non-noble metal is selected for the foam metal, a plating layer may need to be applied to the foam metal. For example, the plating layer can be gold, gold over nickel, gold over palladium and nickel, or another type of plating layer. Moreover, an elastomer can be applied inside and outside the foam metal of the conductive contact 40. The elastomer can be a silicone elastomer or another type of elastomer.

Figure 7:
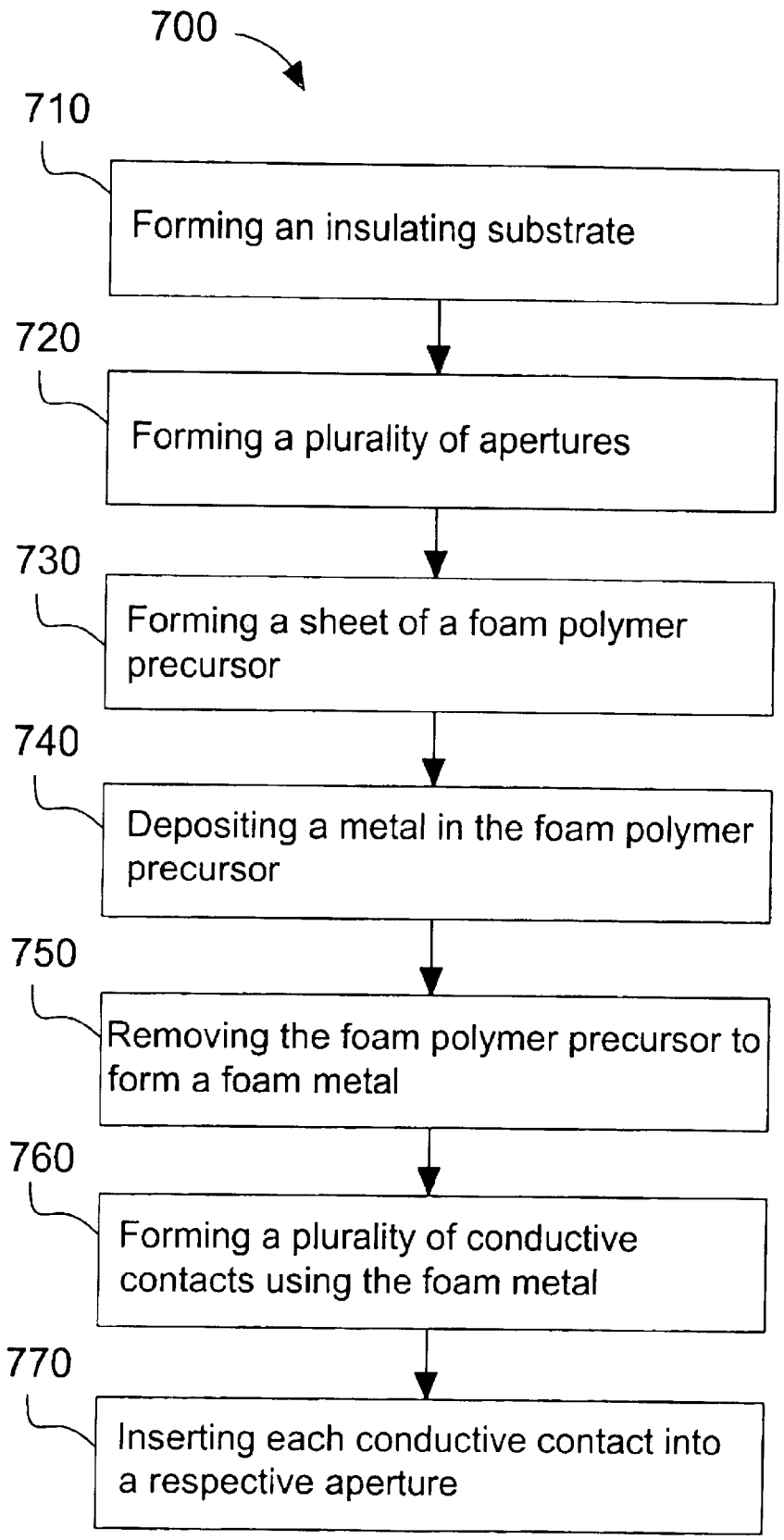
FIG. 7 illustrates a flow chart showing a third method of manufacturing a socket in accordance with an embodiment of the present invention.

FIG. 7 illustrates a flow chart showing a third method 700 of manufacturing a socket in accordance with an embodiment of the present invention. Reference is made to FIGS. 1–4B. At Block 710, an insulating substrate 50 is formed. The insulating substrate 50 can be flexible or rigid. Moreover, the insulating substrate 50 is comprised of a nonconductive material. For example, the nonconductive material can be a polymer such as a liquid crystal polymer. Alternatively, the nonconductive material can be a polyester or other type of nonconductive material. The insulating substrate 50 can be made through an injection molding process into the desired shape and dimensions. Alternatively, a sheet of nonconductive material (e.g., polymer sheet) can be made. The insulating substrate 50 can be cut from the sheet of nonconductive material (e.g., polymer sheet). At Block 720, a plurality of apertures are formed in the insulating substrate 50 for inserting therein the conductive contacts 40.

Continuing at Block 730, a sheet of a foam polymer precursor is formed. The foam polymer precursor is porous. The foam polymer precursor acts like a deposition precursor for the metal forming the foam metal, thus, penetrating into the foam polymer precursor.

Furthermore, at Block 740, the metal is deposited into the foam polymer precursor to form the foam metal. A variety of methods, such as physical vapor deposition, can be used. At Block 750, the foam polymer precursor is removed by using an organic liquid or by evaporating it out, forming the foam metal.

At Block 760, a plurality of conductive contacts 40 are formed using the foam metal. The foam metal can be cut and formed into the cylindrical shape and dimensions of the conductive contacts 40. Moreover, at Block 770, the plurality of conductive contacts 40 are inserted into the apertures of the insulating substrate 50.

As described above, if a non-noble metal is selected for the foam metal, a plating layer may need to be applied to the foam metal. For example, the plating layer can be gold, gold over nickel, gold over palladium and nickel, or another type of plating layer. Moreover, an elastomer can be applied inside and outside the foam metal of the conductive contact 40. The elastomer can be a silicone elastomer or another type of elastomer.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A socket for facilitating electrical interconnection, comprising:

an insulating substrate including a first surface and a second surface that is on an opposite side relative to said first surface, wherein said insulating substrate includes a plurality of apertures each aperture providing a passage between said first and second surfaces; and a plurality of conductive contacts each conductive contact positioned in a respective one of said apertures such that a first end of said conductive contact extends from said first surface and a second end of said conductive contact extends from said second surface, wherein each conductive contact comprises a foam metal.

2. The socket as recited in claim 1 further comprising a chip package electrically coupled to said conductive contacts disposed in said first surface.

3. The socket as recited in claim 2 further comprising a circuit board electrically coupled to said conductive contacts disposed in said second surface.

4. The socket as recited in claim 1 further comprising a daughter circuit board electrically coupled to said conductive contacts disposed in said first surface.

5. The socket as recited in claim 4 further comprising a mother circuit board electrically coupled to said conductive contacts disposed in said second surface.

6. The socket as recited in claim 1 wherein said foam metal is one of copper, copper alloy, silver, silver alloy, gold, nickel, and molybdenum.

7. The socket as recited in claim 1 wherein each conductive contact further includes a plating layer.

8. The socket as recited in claim 7 wherein said plating layer is one of gold, gold and nickel, and gold and palladium and nickel.

9. The socket as recited in claim 1 wherein said insulating substrate is one of a polymer and a polyester.

10. The socket as recited in claim 1 wherein said plurality of apertures are arranged according to a land grid array format.

11. A socket for facilitating electrical interconnection, comprising:

an insulating substrate including a first surface and a second surface that is on an opposite side relative to said first surface, wherein said insulating substrate includes a plurality of apertures each aperture providing a passage between said first and second surfaces; and a plurality of conductive contacts each conductive contact positioned in a respective one of said apertures such that a first end of said conductive contact extends substantially perpendicularly from said first surface and a second end of said conductive contact extends substantially perpendicularly from said second surface, wherein each conductive contact comprises a foam metal and an elastomer.

12. The socket as recited in claim 11 further comprising a chip package electrically coupled to said conductive contacts disposed in said first surface.

13. The socket as recited in claim 12 further comprising a circuit board electrically coupled to said conductive contacts disposed in said second surface.

14. The socket as recited in claim 11 further comprising a daughter circuit board electrically coupled to said conductive contacts disposed in said first surface.

15. The socket as recited in claim 14 further comprising a mother circuit board electrically coupled to said conductive contacts disposed in said second surface.

16. The socket as recited in claim 11 wherein said foam metal is one of copper, copper alloy, silver, silver alloy, gold, nickel, and molybdenum.

17. The socket as recited in claim 11 wherein said foam metal of each conductive contact further includes a plating layer.

18. The socket as recited in claim 17 wherein said plating layer is one of gold, gold and nickel, and gold and palladium and nickel.

19. The socket as recited in claim 11 wherein said insulating substrate is one of a polymer and a polyester.

20. The socket as recited in claim 11 wherein said plurality of apertures are arranged according to a land grid array format.

21. The socket as recited in claim 11 wherein said elastomer is a silicone elastomer.

* * * * *